US009267353B2

(12) United States Patent
Xu

(10) Patent No.: US 9,267,353 B2
(45) Date of Patent: Feb. 23, 2016

(54) BACKUP SYSTEM FOR PACKER SEALING ELEMENT

(75) Inventor: YingQing Xu, Tomball, TX (US)

(73) Assignee: Baker Hughes Incorporated, Houston, TX (US)

( * ) Notice: Subject to any disclaimer, the term of this patent is extended or adjusted under 35 U.S.C. 154(b) by 859 days.

(21) Appl. No.: 13/324,794

(22) Filed: Dec. 13, 2011

(65) Prior Publication Data

US 2013/0147121 A1 Jun. 13, 2013

(51) Int. Cl.
*E21B 33/128* (2006.01)

(52) U.S. Cl.
CPC ..... *E21B 33/128* (2013.01)

(58) Field of Classification Search
CPC ..... E21B 33/128; E21B 33/1216
USPC ..... 277/322, 328, 329, 331, 336, 337, 341, 277/605, 646; 166/191, 196, 202, 206, 387
See application file for complete search history.

(56) References Cited

U.S. PATENT DOCUMENTS

| | | | | |
|---|---|---|---|---|
| RE32,831 | E | 1/1989 | Shonrock et al. | |
| 5,775,429 | A * | 7/1998 | Arizmendi et al. | 166/387 |
| 5,941,313 | A * | 8/1999 | Arizmendi | 166/387 |
| 6,142,227 | A * | 11/2000 | Hiorth et al. | 166/123 |
| 6,164,375 | A | 12/2000 | Carisella | |
| 6,311,778 | B1 | 11/2001 | Carisella et al. | |
| 6,318,461 | B1 | 11/2001 | Carisella | |
| 7,128,145 | B2 | 10/2006 | Mickey | |
| 2002/0162667 | A1 * | 11/2002 | Ingram et al. | 166/387 |
| 2003/0217844 | A1 * | 11/2003 | Moyes | 166/118 |
| 2004/0149429 | A1 | 8/2004 | Dilber et al. | |
| 2005/0115720 | A1 | 6/2005 | MacKenzie et al. | |
| 2009/0071641 | A1 | 3/2009 | Gaudette et al. | |
| 2010/0071908 | A1 | 3/2010 | Bishop et al. | |
| 2010/0072711 | A1 * | 3/2010 | Doane et al. | 277/404 |
| 2011/0036561 | A1 | 2/2011 | Bishop et al. | |
| 2011/0061857 | A1 * | 3/2011 | White | 166/196 |

* cited by examiner

*Primary Examiner* — Vishal Patel
*Assistant Examiner* — Stacy Warren
(74) *Attorney, Agent, or Firm* — Steve Rosenblatt

(57) ABSTRACT

Backup rings are disposed on opposed sides of a sealing element. The backup rings are initially bow shaped in the run in position. Opposed ends of the bow shape are brought together to extend the extrusion barriers and compress the sealing element. The relative axial movement that brings the opposed ends of the bow shape together results in radially extending the bow shape. The bow shape is reformed into a teardrop shape that extends radially beyond a pinch location created by relative axial movement of adjacent support members coming closer together. A sealing element extends radially during the deployment of the extrusion barriers and is contained between them. The extension of the extrusion barriers allows conformance to surface irregularities in the surrounding tubular or wellbore wall.

17 Claims, 11 Drawing Sheets

BACKUP SYSTEM FOR PACKER SEALING ELEMENT

FIELD OF THE INVENTION

The field of the invention is seal backup systems for subterranean packers and more particularly conforming backup members that adapt to any out of roundness or irregularity of the surrounding tubular or wellbore wall.

BACKGROUND OF THE INVENTION

When packers are set to isolate zones in a subterranean location the differential pressure across the sealing element can force that element to extrude axially in the direction of the pressure differential. Backup ring structures have been used to address the tendency to extrude under differential pressure loading. A collection of segments that overlap and can be forced out by relative axial component movement have been tried such as in US Publication 2011/0036561 and US Publication 2010/0071908. Despite the use of many segments to make an annular backup assembly the nature of the way the parts fit together and move radially does not always allow the components to adequately conform to out of roundness or surface irregularities of the surrounding tubular or the wellbore wall.

Some designs provided cup shaped backup ring stacks that has staggered slots as between layers as an extrusion barrier in expansion ranges up to 25%. U.S. Pat. No. 6,827,150 is an illustration of one such design. Others are U.S. Pat. No. 7,128,145; US Publication 2004/0149429 and 2005/0115720. Other high expansion packer designs are US Re 32,831; U.S. Pat. Nos. 6,311,778; 6,318,461 and 6,164,375.

Despite the variation of designs for backup rings as extrusion barriers the issue of gaps around the periphery remained and is addressed by the present invention.

In the field of metal to metal seals a design has been developed that features a bow shaped sealing element that is axially compressed at opposed base locations and then pinched between two relatively movable members as the element extends to make metal to metal contact with the opposing tubular as illustrated in US Publication 2009/0071641. In one embodiment soft metals or elastomers can be added at the opposing wall contact location to address the wall imperfections of the surrounding tubular to enhance the performance of the seal. A variation of this design for seals uses a flimsy metal annular shape filled with rubber and compressed on opposed ends so that the metal outer shape obtains structure from the interior fill material to seal against the surrounding tubular. This design is shown in U.S. Pat. No. 5,775,429 with many variations including an application as an extrusion barrier in FIGS. 8 and 9.

The present invention focuses on improving performance of backup rings where conformance to irregular surfaces is a feature. Axial relative movement results in collapsing a bow shaped backup ring on either side of a sealing element when the backup rings are converted to a teardrop shape by pinching along a length of the radially extending shape with relative axial movement between compressing members that support the ends of the bow shape. These and other aspects of the present invention will be more readily apparent to those skilled in the art from a review of the description of the preferred embodiment and associated drawings while recognizing that the full scope of the invention is to be found in the appended claims.

SUMMARY OF THE INVENTION

Backup rings are disposed on opposed sides of a sealing element. The backup rings are initially bow shaped in the run in position. Opposed ends of the bow shape are brought together to extend the extrusion barriers and compress the sealing element. The relative axial movement that brings the opposed ends of the bow shape together results in radially extending the bow shape. The bow shape is reformed into a teardrop shape that extends radially beyond a pinch location created by relative axial movement of adjacent support members coming closer together. A sealing element extends radially during the deployment of the extrusion barriers and is contained between them. The extension of the extrusion barriers allows conformance to surface irregularities in the surrounding tubular or wellbore wall.

DETAILED DESCRIPTION OF THE PREFERRED EMBODIMENT

Initially it is to be understood that the backup ring created as disclosed herein performs better in one respect due to its teardrop cross sectional shape. The shape itself helps to absorb backlash in the setting force and therefore renders the backup ring more reliable. This is described in more detail in connection with one embodiment of a backup ring that forms the stated shape. It is also to be understood that although the drawings hereof illustrate a backup ring that bows radially outwardly, the components can easily be reversed such that the backup ring will bow radially inwardly such that the backup ring will be formed against a tubular radially inwardly disposed of the backup ring device rather than radially outwardly of the backup ring device as specifically illustrated.

Figure 1:
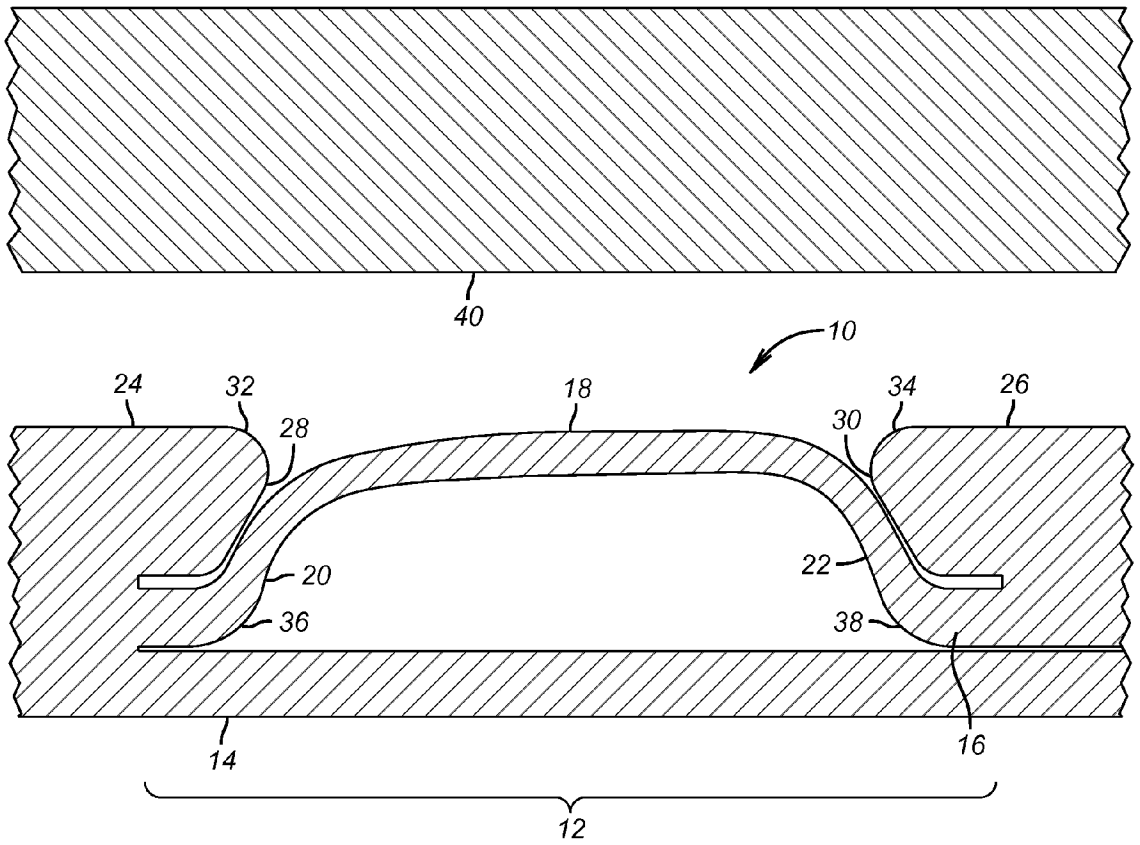
FIG. 1 is a schematic view of one embodiment of a backup ring disclosed herein in a run in condition.

Referring to FIG. 1, an embodiment of a backup ring 10 in accordance with this disclosure is illustrated. The backup ring 10 comprises a backup ring body 12 having a first end ring 14 and a second end ring 16. Backup ring body 12 comprises a backup ring bridge 18 and first and second backup ring legs 20 and 22. The legs terminate at roots 36 and 38. Backup ring 10 further includes configurations capable of causing the backup ring body to collapse axially into a set position such as, for example, two gauge rings 24 and 26, each disposed in operable communication with one end of the backup ring body 12. While gauge rings are specifically disclosed, the terms as used herein are intended to convey any configuration capable of loading the backup ring body 12 to set the backup ring 10 and to be instrumental in retrieving the backup ring 10. This "operable communication" as noted is, in one embodiment, a fixed connection to each end ring 14 and 16, respectively, while in other embodiments it can float. The fixed connection as illustrated is adjacent roots 36 and 38. The gauge rings 24 and 26 are also in supportive communication with the legs 20 and 22, respectively. As can be readily seen in FIG. 1, each gauge ring includes an angled surface identified by the numerals 28 and 30, respectively. The surfaces 28 and 30 are roughly parallel to the legs 20 and 22 although not in contact therewith prior to the setting sequence for the backup ring 10. These surfaces 28 and 30 come in contact with the legs 20 and 22 during the setting sequence to support the same as will be better appreciated after exposure to the operation section of this document.

Also visible in FIG. 1 are two radiuses 32 and 34 provided one on each of gauge rings 24 and 26, respectively. The radiuses, in one embodiment, are in a range of about 0.13 to about 0.16 inch. While a wider range is also operable, it has been found that the range of about 0.13 to about 0.16 is effective in minimizing stress in the backup ring body 12 during setting. This is also the purpose for which the angled surfaces 28 and 30 are provided. The angle of the surfaces 28 and 30 is selected to coincide with the angle of legs 20 and 22 as noted above in order to support these structures thereby preventing significant bending thereof during setting of the backup ring 10. Angles for surfaces 28 and 30 range in particular embodiments from about 45 degrees to about 90 degrees. As illustrated, the angles are both about 60 degrees. The range indicated has been found to work well though it is to be appreciated that angles outside the exemplary range are also contemplated but may not reduce stress in legs 20 and 22 to the extent of the reduction found in the identified range.

The prevention of bending reduces work hardening effects that would otherwise be experienced in these locations. Such reduction in work hardening effectively equates to more residual elasticity in the material of the seal in locations of the seal (legs and roots) that will be subject to bending stresses upon retrieval of the seal. During setting of the seal the bending stress is localized in the bridge 18 and in retrieval, bending stress is localized in the legs and roots. Generally, materials that are somewhat ductile can be bent at least once without breaking, work hardening, of course, building within the material during this and any subsequent bending stress. Since in the disclosed backup ring, the configuration ensures that bending is experienced substantially only once in each localized area of the backup ring body 12, the likelihood of each localized area enduring sufficient stress to rupture is dramatically reduced. The protective action of the surfaces 28 and 30 extends to both the legs 20 and 22 and leg roots 36 and 38, respectively. By avoiding stress in these structures during setting of the backup ring 10, the ability to retrieve the backup ring 10, without suffering a rupture of the backup ring, is facilitated. It is further noted that in the backup ring 10, nowhere is there a sharp bend of the material of the backup ring body 12. Rather, all bends are gradual thereby spreading the stress over a broader area of the backup ring material. This avoids point stresses that generally create weaknesses in the backup ring both while being initially deformed and certainly while being retrieved. As such, embodiments of the invention alleviate the problem found in the prior art as noted above.

One last point that should be made prior to a discussion of actuation of an exemplary backup ring 10 is that backup ring body 12 is a machined part in one embodiment such that there are no, or extremely little, residual stresses in the body 12 in the position shown in FIG. 1. Little residual stress in the backup ring body 12 prior to deformation in use is a benefit as this helps to minimize the magnitude of stresses experienced by the body 12 during setting. As the purpose of this configuration is the reduction in initial stress of the body 12, it is noted that an alternate arrangement is that body 12 could be a preformed and stress relieved component for some applications or even a molded component for some applications. Again, the important thing is that the position illustrated at the roots 36 and 38 is a position of the backup ring body 12 that should exist prior to setting of the backup ring, with very little residual stress. Further, stress is not introduced into roots 36 and 38 during the setting of the backup ring 10 due to the configuration of the gauge rings thereby retaining elasticity of the material of the body 12 in the legs and the roots. This is to the operator's advantage during retrieval of the backup ring 10, as noted above.

Figure 2:
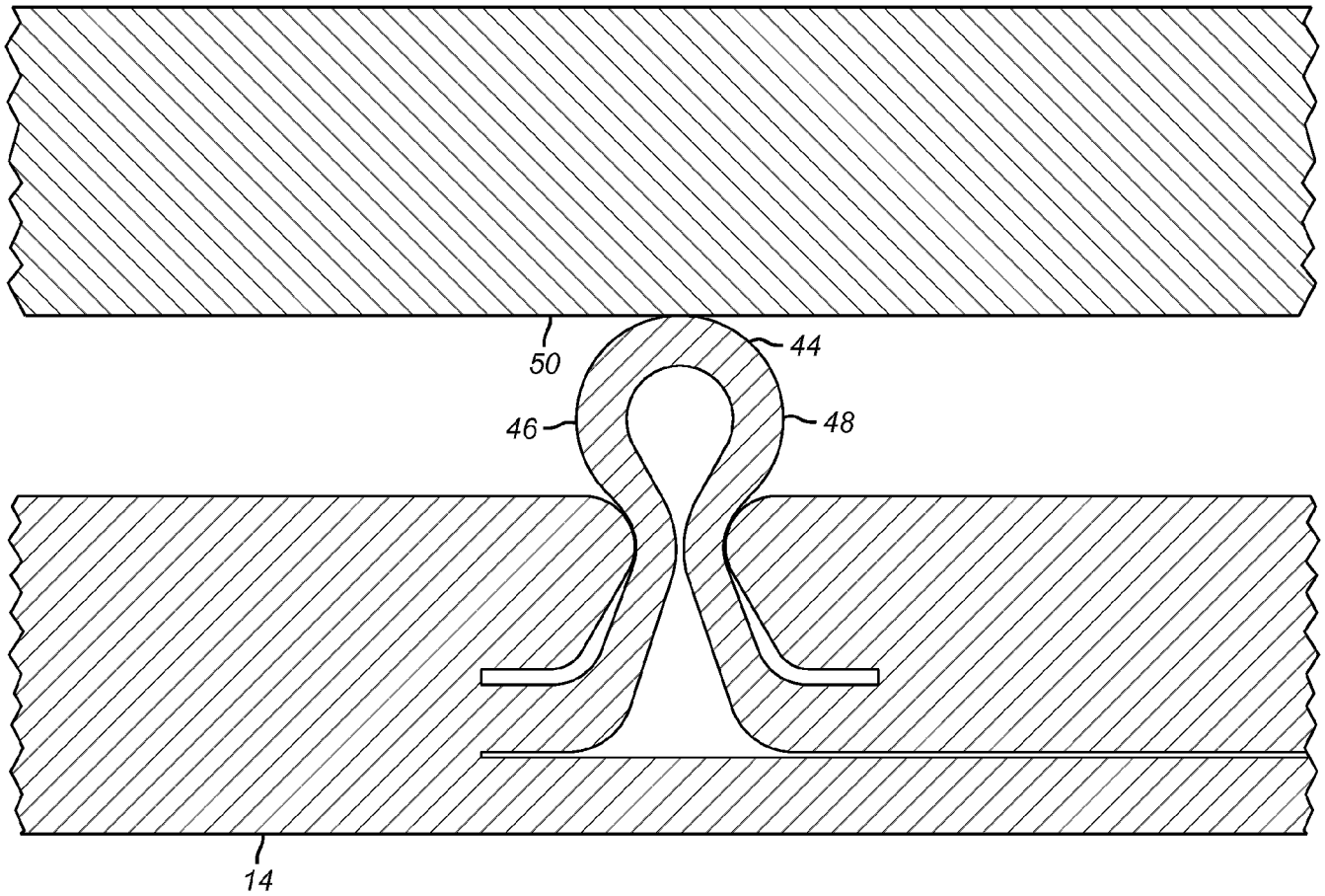
FIG. 2 is a schematic view of the embodiment of FIG. 1 illustrated in a set position.

Referring now to FIGS. 1 and 2 simultaneously, setting of backup ring 10 is illustrated. Backup ring 10 is set through the application of an axial load resulting in the space between the gauge rings diminishing. This can be effected in a number of ways including: 1) by causing at least one of the gauge rings to move toward the other of the gauge rings while the "other" gauge ring is stationary; 2) to cause one ring to move toward the "other" ring while the other ring moves away from the one ring more slowly than the one ring is moving toward the other ring; or 3) to cause one ring to move toward the other ring while the other ring is moving towards the one ring. For illustrative purposes, the drawings and description herein are directed to an embodiment where gauge ring 24 is moved while gauge ring 26 remains stationary through, for example, operable contact with an anchoring mechanism (not shown).

Due to the shape of body 12, one will appreciate that axial shortening thereof will necessarily cause the body 12 to bulge outwardly. What may not be immediately appreciated from the drawings, however, is the action of gauge rings 24 and 26 on the process. As gauge rings 24 and 26 are moved so that they are closer to one another, surfaces 28 and 30 come into contact with legs 20 and 22, respectively. As contact is made in this location, the legs 20 and 22 are substantially supported such that they and the roots 36 and 38 from which the legs extend experience very little bending stress while the backup ring 10 is being set. Since the distance between gauge rings 24 and 26 is still being reduced, however, the backup ring body 12 must necessarily still react. Due to the supported condition of legs 20 and 22, a great majority of the bending stress in the body 12 is concentrated in the bridge 18. The stress in bridge 18 causes it to bow outwardly until it makes contact with an inside surface 40 of a tubular in which the backup ring 10 is being set. Once contact is made at surface 40, a load useful for creating the desired backup ring begins to build. As gauge rings 24 and 26 continue to be urged into closer proximity with one another it will become apparent that radiuses 32 and 34 are also important to reducing stress in the backup ring body 12. In the position of FIG. 2, it will be easily appreciated that were the radiuses to be significantly sharper, much higher stress would be experienced by the backup ring body 12 at the contact point with such radiuses. It has been determined by the inventors hereof that a radius range of from about 0.13 inches to about 0.16 inches produces a desirably low stress in the backup ring body 12.

It is to be appreciated from FIG. 2 that the bridge 18 is deformed such that over an axial length thereof, more than 180 degrees of repositioning is represented. In other words, the bridge 18 is deformed from relatively flat to beyond U-shaped. In the illustrated embodiment of FIG. 2, it will be appreciated that the bridge is nearly a closed teardrop shape 44. In the condition illustrated in FIG. 2 substantial sealing force is applied to surface 40 such the pressure may be held in either direction relative to backup ring 10. Important to notice as well is that because of the teardrop shape of bridge 18, backlash in the setting system is better absorbed than in prior art backup ring systems. This is because with a reduction in the sealing force at gauge rings 24 and 26 move slightly away from each other. When this occurs, elastic resilience in the bridge 18 will tend to straighten the two sides 46 and 48 of the teardrop shape 44. This will tend to increase loading at interface 50 with surface 40 rather than to reduce loading at interface 50 which would have been common in the prior art.

Figure 3A:
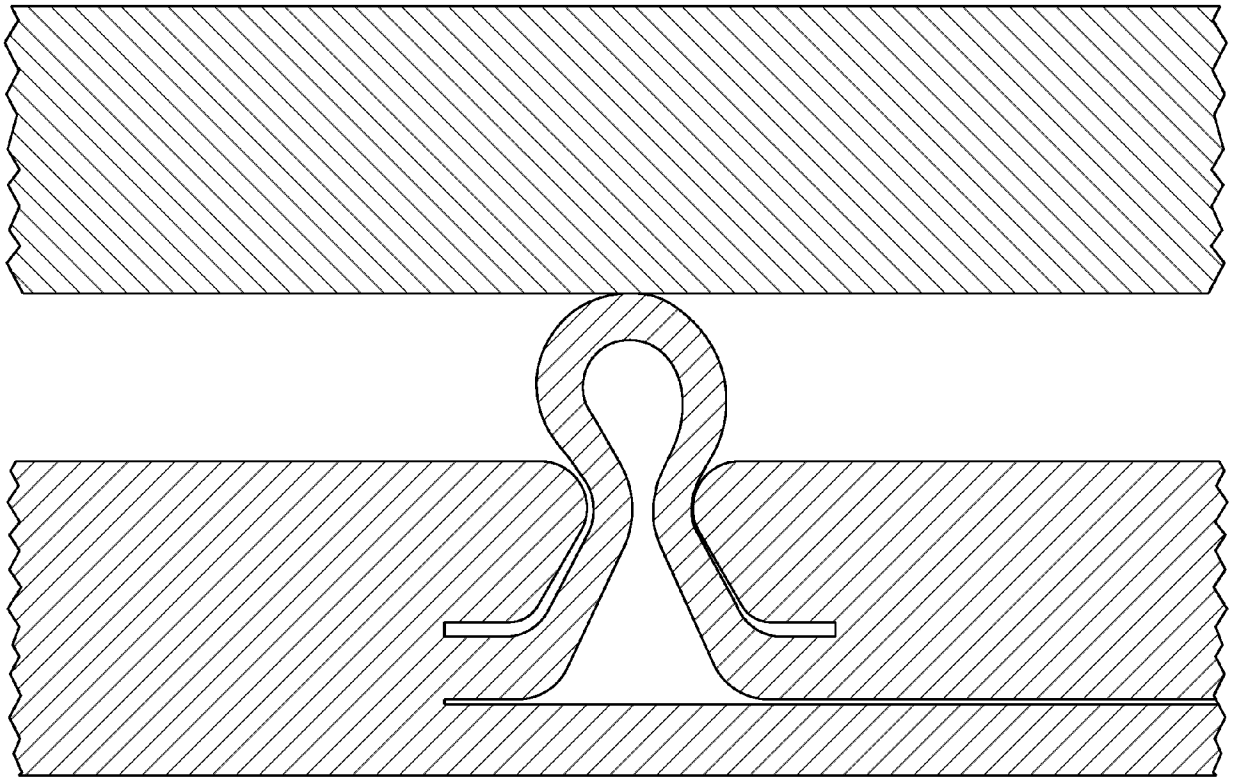
FIGS. 3A-3F represent sequential views of the seal of FIG. 1 withdrawing from the set position during retrieval.
Figure 3B:
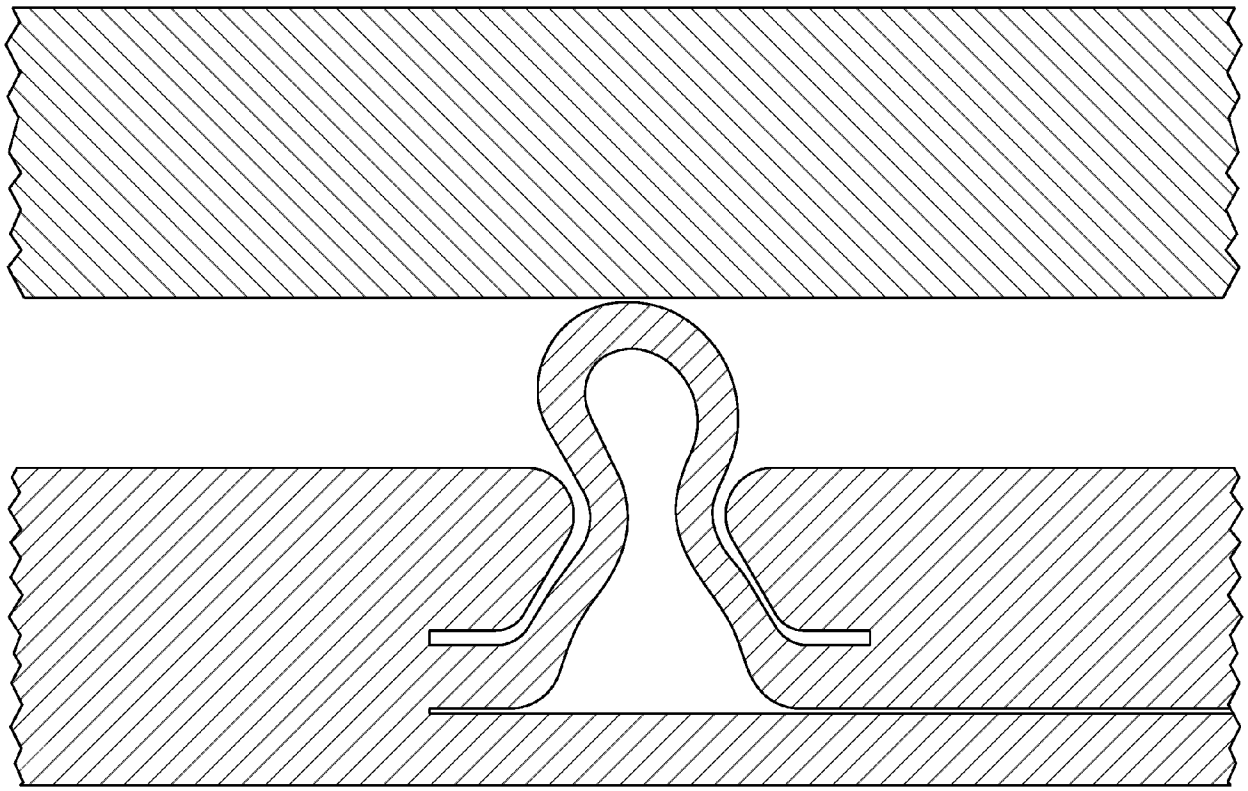
Figure 3C:
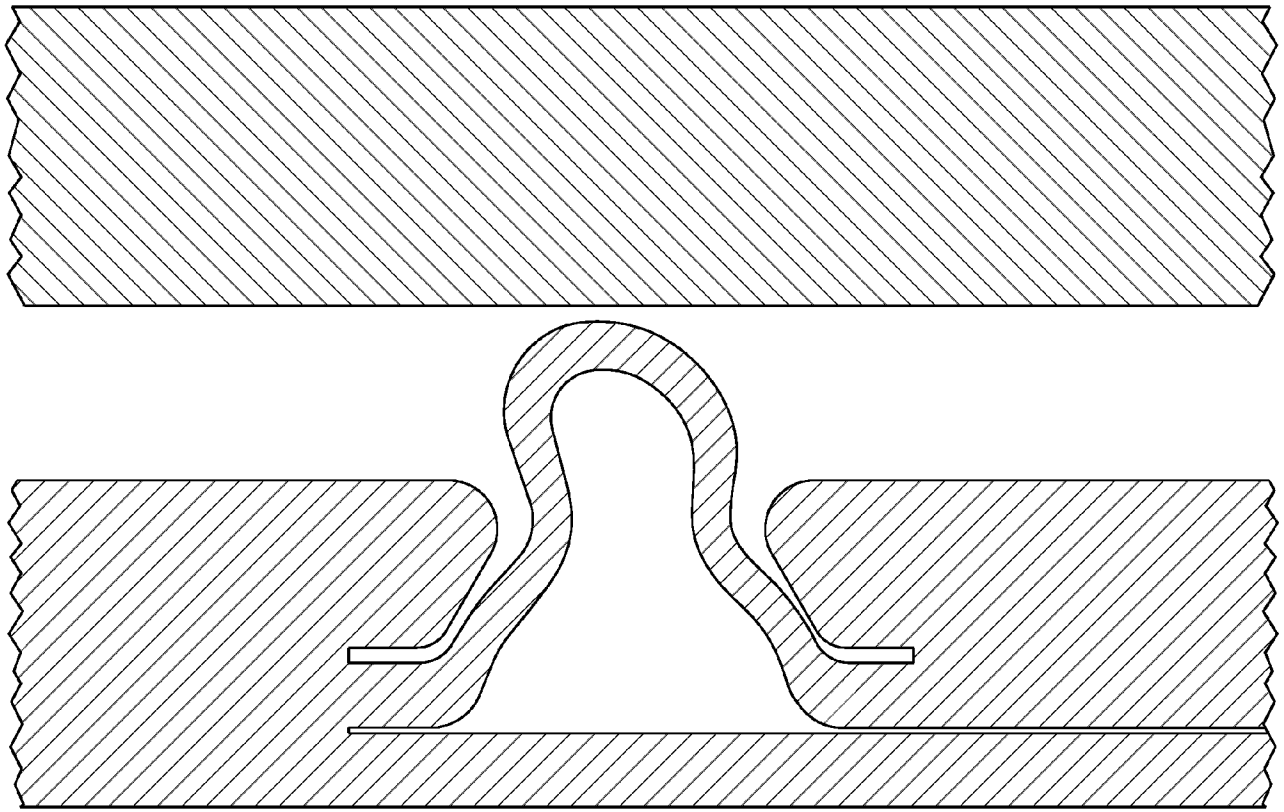
Figure 3D:
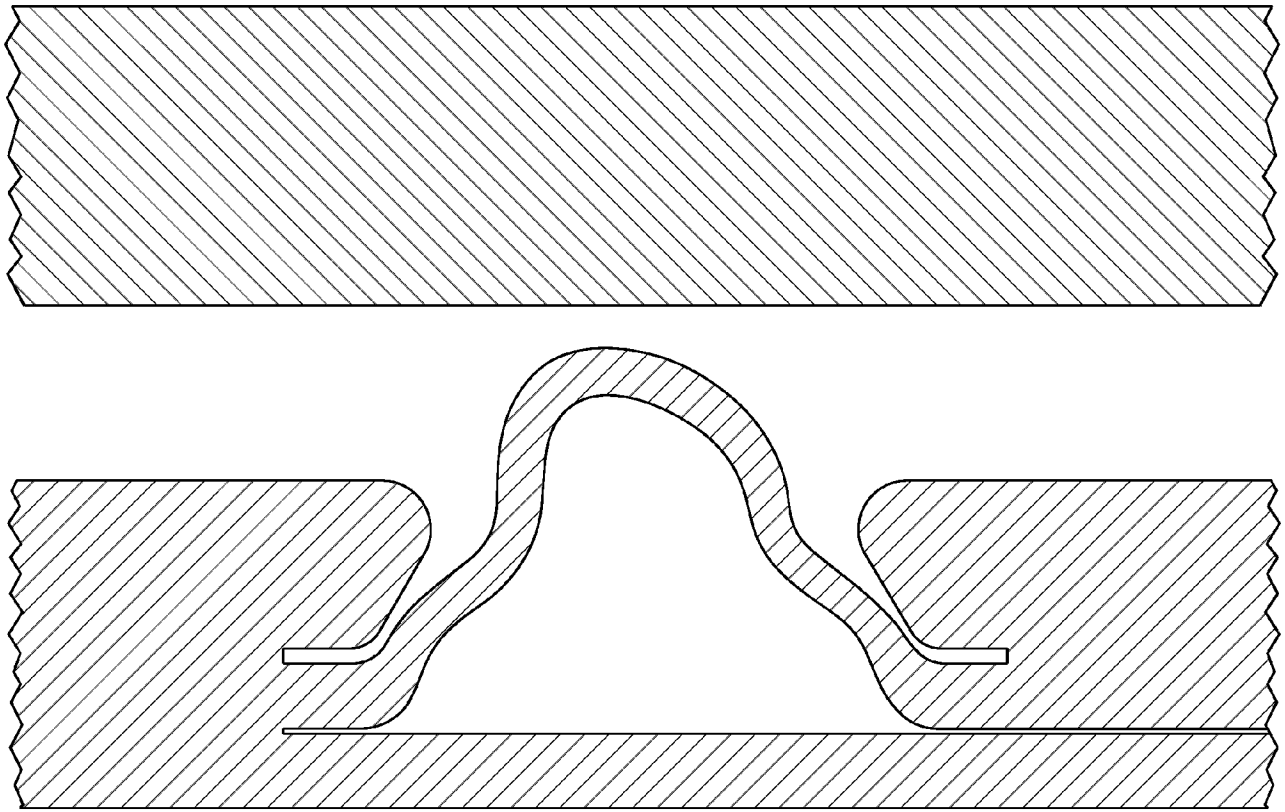
Figure 3E:
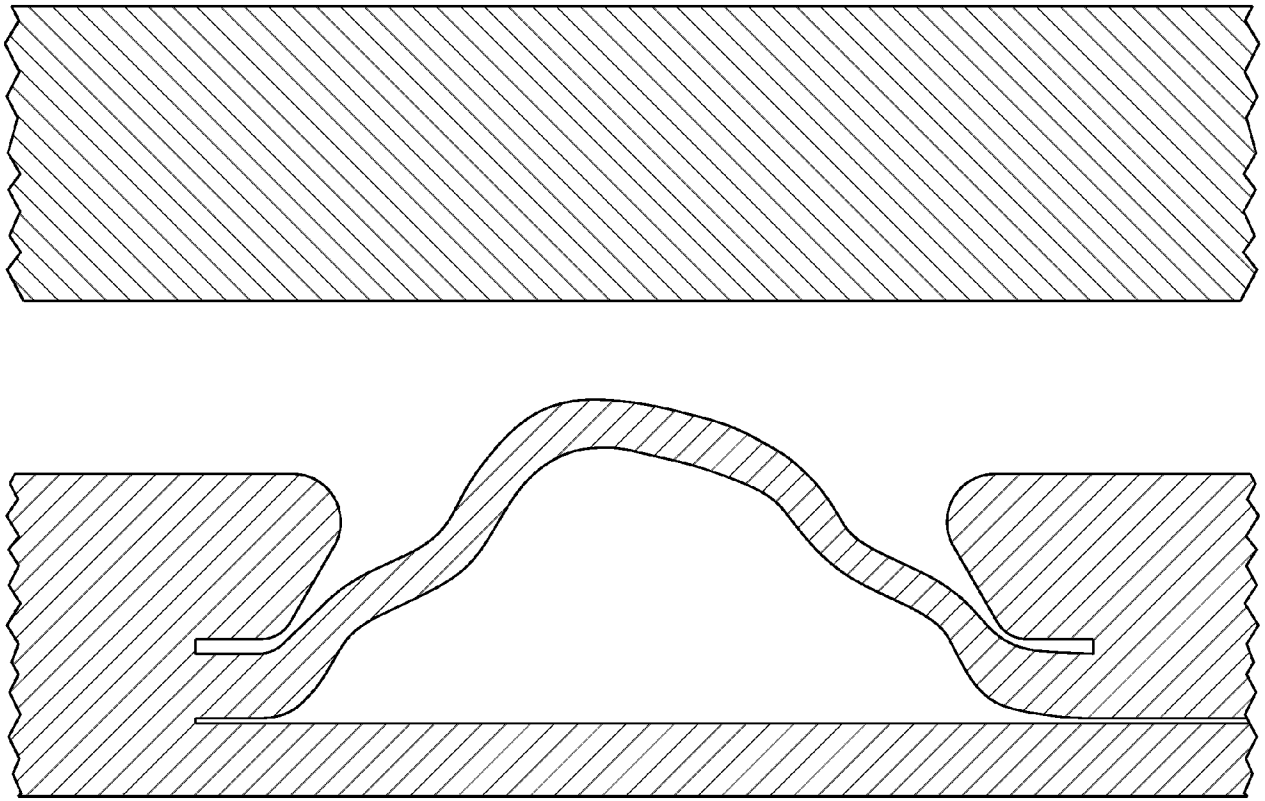
Figure 3F:
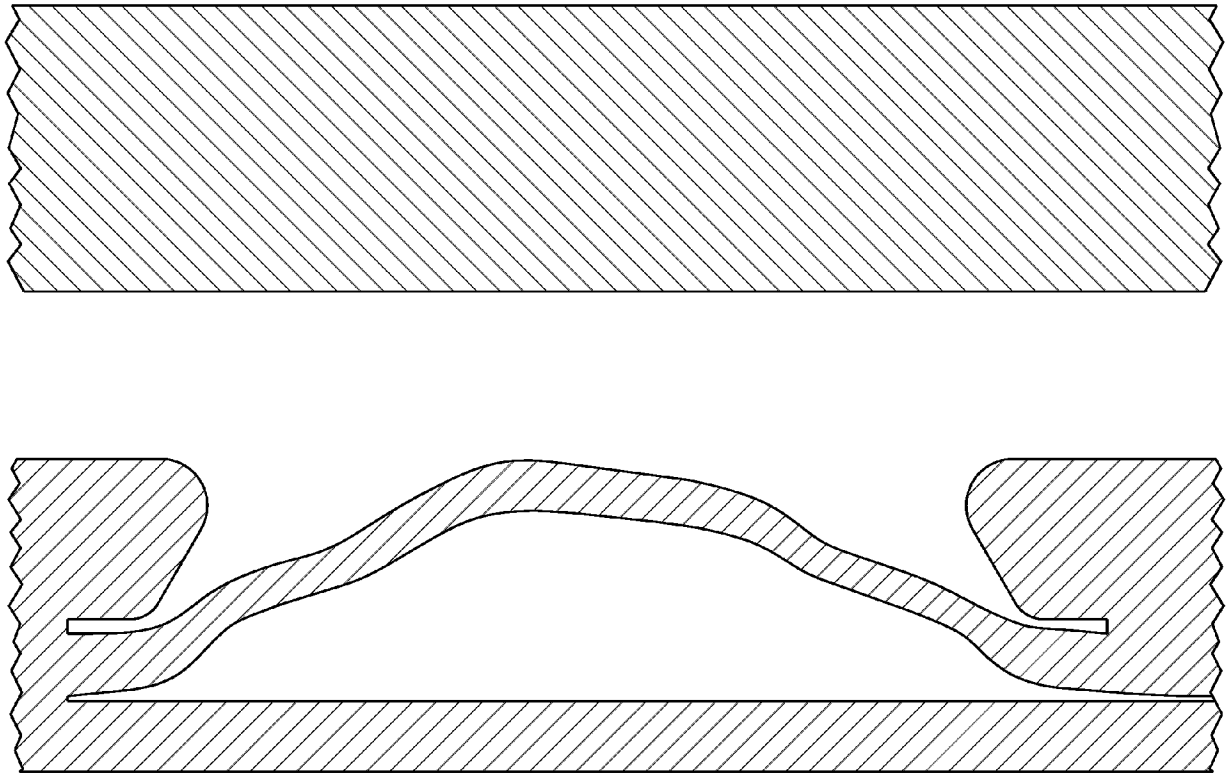

Referring now to FIGS. 3*a* through 3*f* retrieval of backup ring 10 is illustrated in sequence. It is important to note in this sequence of drawings the relative positions of the legs 20 and 22 versus the teardrop shape 44 as they are illustrated in FIGS. 3*b* and 3*c*. Upon review of these figures it will become apparent to one of ordinary skill in the art that the teardrop shape 44 is maintained substantially intact while the legs 20 and 22 and the roots 36 and 38 are subjected to tensile bending stress and experienced a greater degree of movement. This is beneficial since as noted above the legs and roots are protected from bending stress during initial setting of this backup ring. Therefore they have significantly greater elasticity than the bridge 18, which has been work hardened, at this stage in use of the backup ring 10. With reference to FIG. 3*d*, it can be ascertained that the bridge 18 has begun to reopen but it is also important to note that the interface 50 has come out of contact with surface 40 by a significant margin at this point in the retrieval process. While more bending stress is being added to bridge 18 at this point in the process a rupture is less likely to create a problem. Moving on to FIGS. 3*e* and 3*f* the backup ring has already been substantially withdrawn and again rupture at this point is less damaging. It will also be appreciated by the reader at legs 20 and 22 and roots 36 and 38 are now significantly deformed but because this deformation is the first bending stress experienced by those components, they are highly likely to survive that stress.

The foregoing description might be reasonably understood to relate to only a symmetrically positioned backup ring. It is to be appreciated however that depending upon the type of movement utilized during the setting process it is sometimes advantageous to prepare the backup ring 10 as a non-symmetrical device. More specifically, and utilizing one-gauge-ring movement as an example, if gauge ring 24 is moved toward gauge ring 26 while gauge ring 26 is held in a stationary position it is reasonably likely that the teardrop shape 44 will contact the inside surface 40 (at interface 50) before the backup ring 10 is fully set. While it is subtle in the drawings utilized to exemplify the invention, careful consideration of the illustrated position of interface 50 relative to a centerline of the backup ring 10 will show that it is offset in the direction of gauge ring 24. This is because of the contact with surface 40 prior to fully setting of the backup ring 10. Once contact is made at interface 50, the positioning of side 48 is relatively fixed and the positioning of side 46 will continue to change. Side 46 will deflect under the impetus of gauge ring 24 to have a greater curvature than that of side 48. Because it is desirable to promote symmetry as much as practicable in teardrop 44 it may be desirable in certain applications to vary a thickness of the backup ring body 12 over its length. More specifically is possible to utilize thickness of backup ring body 12 to encourage early deformation in some portions of the backup ring body 12 and delayed deformation in other portions of the backup ring body 12. Generally speaking in order to enhance symmetry in the teardrop 44 a lesser thickness at the more relatively fixed end of backup ring body 12 will allow side 48 to more readily deform into a desirable position. Likewise, while the angles of the angled surfaces 28 and 30 and the radiuses 32 and 34 need not be symmetrical and in some applications may be better operable by being disparate. It is further to be understood that although the disclosure hereinabove describes an embodiment where each component is mirrored on both axial ends of the backup ring 10, albeit not necessarily with the identical dimensions or shapes, the teardrop shape can still be created with asset of the identified components on but one axial side of the backup ring 10 with the other side being simply attached to a carrier component.

Figure 4:
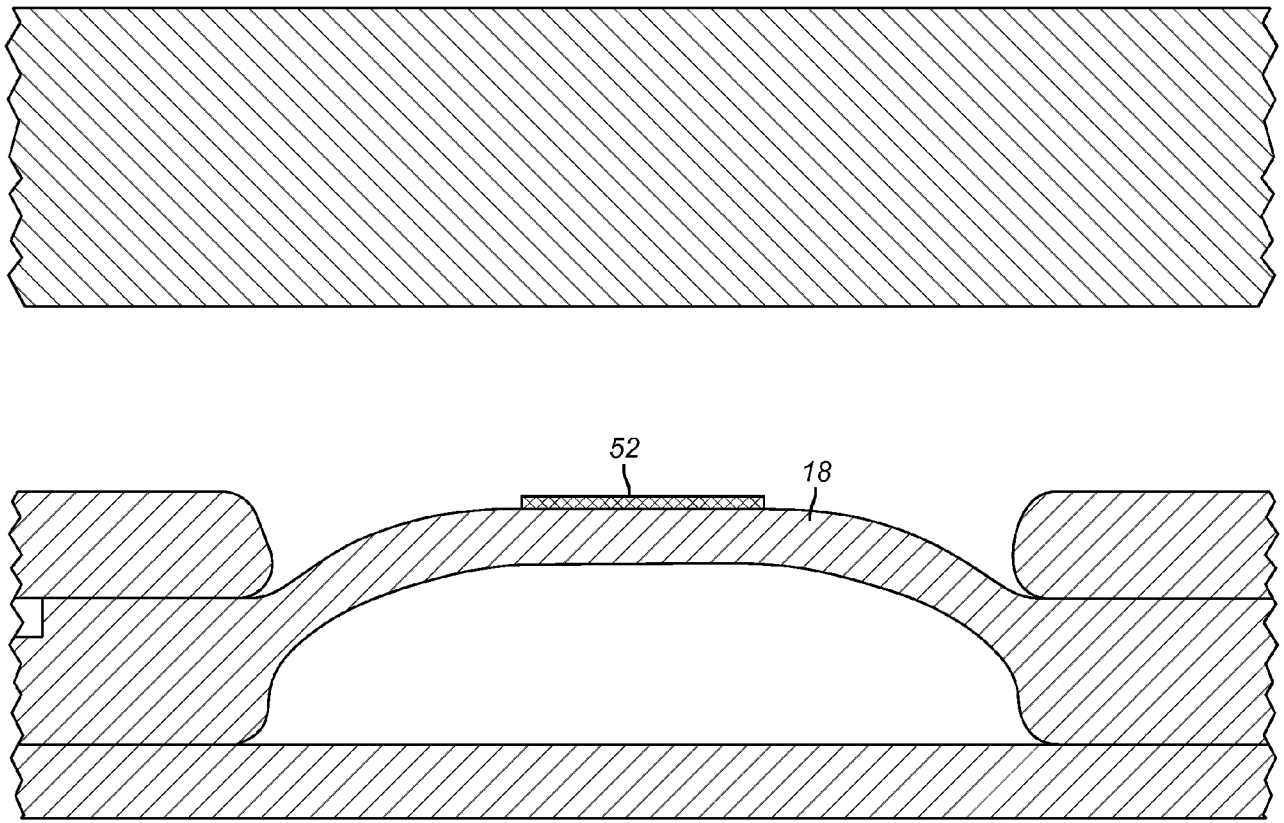
FIG. 4 is a schematic view of an alternate embodiment in a run in condition.
Figure 5:
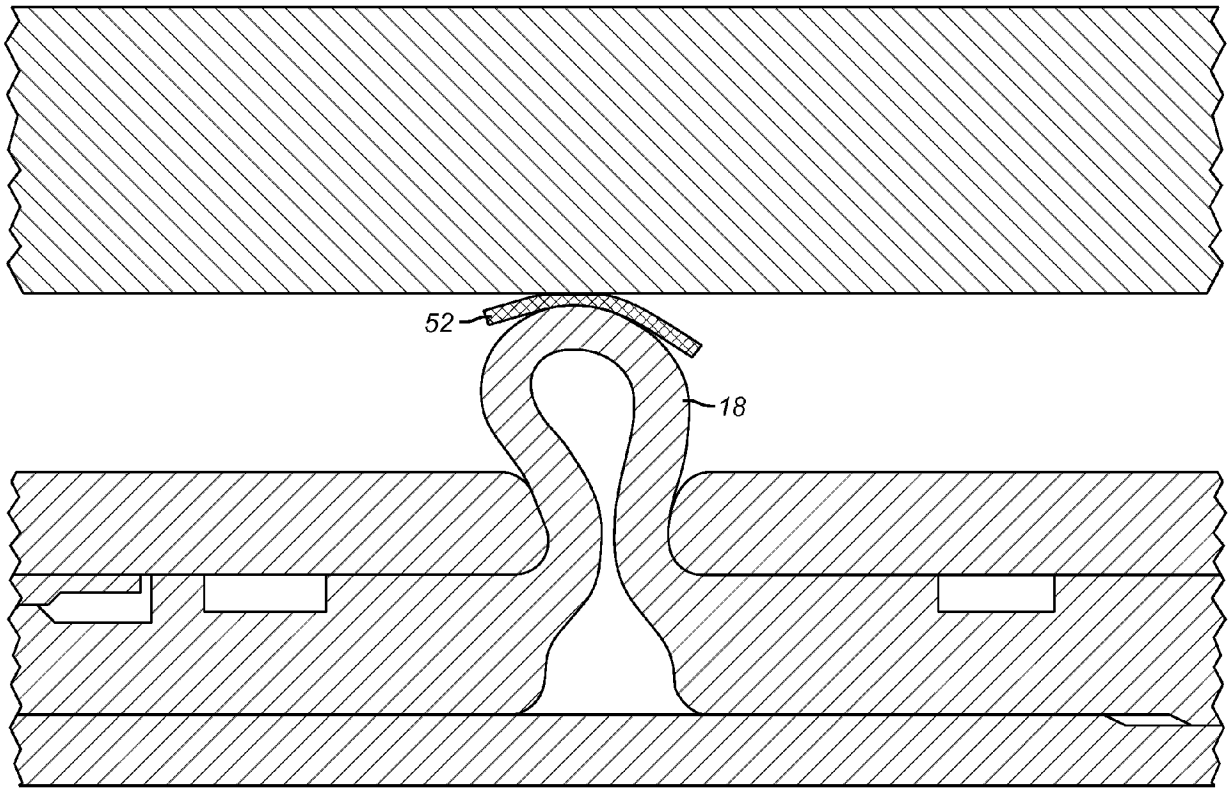
FIG. 5 is the embodiment of FIG. 4 in a set position.

Referring now to FIGS. 4 and 5, an alternate embodiment is illustrated having a separate material 52 to enhance sealing properties of the bridge 18 at a seal interface thereof and against the inside surface 40. Although the material 52 is illustrated as a separate piece from the material of the bridge, it is also contemplated that the material 52 could be a coating on the bridge or the bridge could be that material. Whether configured as a separate piece or as a coating, the material 52 is a relatively soft material such as soft metal like copper, gold, silver, palladium, platinum, tin, lead, bismuth, etc, or alloys of these metals that can be applied to the bridge by such methods as plating, brazing, thermal spray, sputtering, etc. or elastomers, or plastic materials such as Teflon, Polyetheretherketones (PEEK), etc. that can be applied and/or bonded by various industry recognized processes, which enhances the sealing operation by deforming easily to imperfections in the inside surface 40 as well as geometric variations in the backup ring due to the eccentric bending that occurs therein. In all other respects, the configuration is the same as that of the foregoing disclosure.

Figure 6:
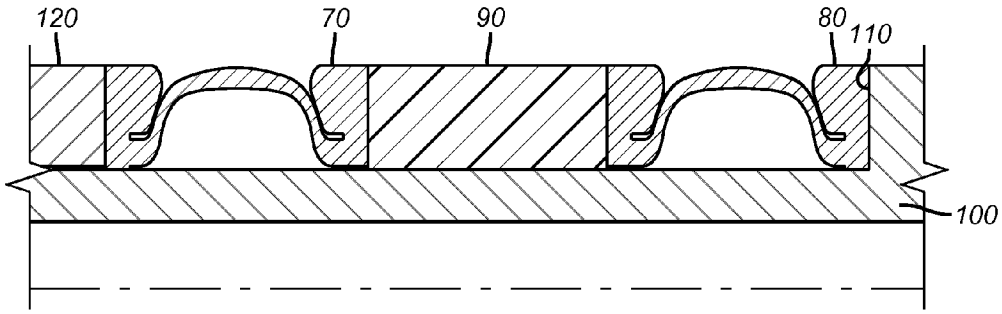
FIG. 6 is a section view of a packer using the extrusion barriers and shown in the run in position.
Figure 7:
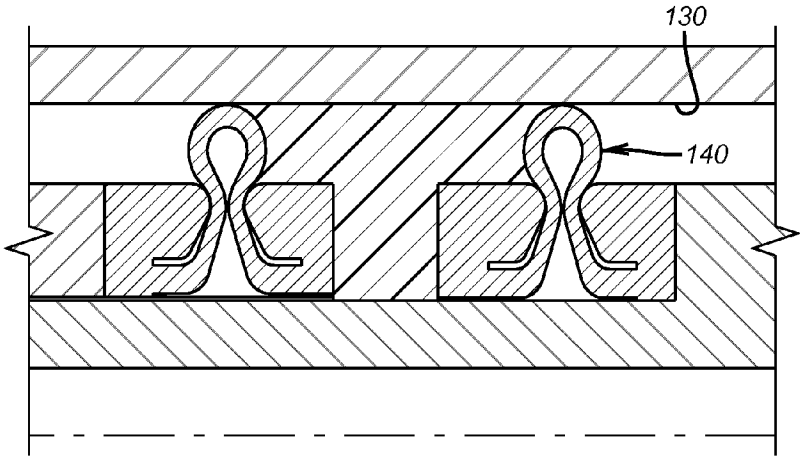
FIG. 7 is the view of FIG. 1 in the set position.

Referring now to FIGS. 6 and 7 the run in and set positions of the backup rings 70 and 80 described in detail above are shown with the sealing element 90 in between and all parts supported on the mandrel 100. Shoulder 110 is stationary and sleeve 120 is pushed toward shoulder 110 to obtain the set position of FIG. 7. Alternatively shoulder 110 can be a part of a movable sleeve that is not shown so that opposed relative movement squeezes the backup rings 70 and 80 to extend to the surrounding tubular or wellbore wall 130 preferably before the sealing element 90 is radially extended to engage the wall 130. When the backup rings 70 and 80 in position against tubular or wall 130 the changing shape of the sealing element 90 can occur in a contained space as illustrated in FIG. 7 where the element 90 is schematically illustrated as substantially filling the space between the end rings 70 and 80. The teardrop shape 140 generally conforms to the surface or wall 130 and preferably seals against it although perfect sealing is not critical in a backup ring application as it would be in a sealing application as discussed in US Publication 2009/0071641.

Although shown in pairs in FIGS. 6 and 7 if the pressure differential is only expected in a single direction then one of the backup members illustrated can be used instead of an opposed pair. Even when a pair is used as illustrated their configurations need not be identical and dimensional variations can be used to compensate for expected wall irregularities or variations in differential extrusion forces after the set position is achieved. Although the seal 90 is shown as a single sleeve, that illustration is schematic and the seal assembly can be a collection of sleeves and spacers that are made of the same or differing materials. Alternatively, two or more backup rings such as 70 or 80 can be placed on either side or both sides of the sealing element 90. The actuation system that extends the backup rings 70 or 80 can be mechanical or pressure set or simply with use of string weight to set down weight to extend the rings.

The sealing element 90 can be bonded to the backup rings 70 and 80 so that retraction of sleeve 120 will first extend ring 70 and then relax the sealing element 90 followed by a retraction of element 80 so that the assembly can be retracted from the subterranean location or relocated and redeployed.

It should be noted that although the foregoing discussion has focused upon the creation of a backup ring, further contemplated is the addition of a roughened surface at the interface of the bridge and a separate structure to act as an anchoring device. The anchoring function can range from a partial anchor and a backup ring to an anchor alone depending upon the desired purpose of the device.

While preferred embodiments have been shown and described, modifications and substitutions may be made thereto without departing from the spirit and scope of the invention. Accordingly, it is to be understood that the present invention has been described by way of illustrations and not limitation.

I claim:

1. A backup ring assembly for a seal selectively engageable against a surrounding tubular or a subterranean borehole wall, comprising:

a mandrel;

a seal on said mandrel; and at least one backup ring adjacent said seal, said backup ring comprising:

a body comprising a bridge;

opposed legs extending from the bridge, the bridge and legs and mandrel defining therebetween a void space;

opposed gauge rings connected to said opposed legs extending from said bridge to provide support for said legs, at least one of said opposed gauge rings selectively movable with respect to said mandrel to cause axial compression of said legs and bridge, thereby forming a configuration of the bridge which extends radially to contact the tubular or wall to assist against extrusion of said seal under differential pressure loading; and sloping planar support surfaces on said opposed gauge rings inclined toward each other in a direction going away from said mandrel and each continuous with a rounded exterior surface for selective contact with said opposed legs that extend at least in part substantially parallel to said respective planar support surfaces, wherein said planar support surfaces are disposed between about 45 and 90 degrees from an axial axis of said seal, said rounded exterior surfaces pushing against said opposed legs upon said relative movement of said opposed gauge rings, said rounded exterior surfaces and said substantially parallel orientation minimizing stress on said backup ring, wherein said pushing by said exterior rounded surfaces against said opposed legs divides said void into a first and a second defined empty voids disposed in a radial direction from each other as measured from said mandrel such that said bridge and at least a portion of said legs that define said second empty void extend into a single contact location with the surrounding tubular or wall.

2. The assembly of claim 1, wherein:

said body is flexible.

3. The assembly of claim 1, wherein:

said opposed legs are of distinct dimensions from one another.

4. The assembly of claim 3, wherein:

distinct dimensions are at least one of length, thickness and angle.

5. The assembly of claim 1, wherein:

said support surfaces for said legs are at an angle that is about 60 degrees with respect to an axial axis of the seal.

6. The assembly of claim 1, wherein:

said support surfaces on said gauge rings are angled identically or differently from each other.

7. The assembly of claim 1, wherein:

said rounded exterior shapes comprise a radius greater than about 0.13 inches.

8. The assembly of claim 1, wherein:

said rounded exterior shapes comprise a radius less than about 0.16 inches.

9. The assembly of claim 1, wherein:

said rounded exterior shapes on said gauge rings are different from one another.

10. The assembly of claim 1, wherein:

said support surfaces or said rounded exterior shapes substantially prevent bending stress in an adjacent said leg during setting of said backup ring.

11. The assembly of claim 1, wherein:

said bridge further comprises a material positioned for selective contact with the tubular or wall that is softer than other parts of said bridge.

12. The assembly of claim 1, wherein:

said gauge rings apply an axial load on said legs to form a teardrop configuration.

13. The assembly of claim 1, wherein:

said at least one backup ring comprises at least one backup ring on each side of said seal that is in contact with said seal upon movement of said at least one of said opposed gauge rings with respect to said mandrel.

14. The assembly of claim 13, wherein:

said backup rings define a space therebetween that is substantially filled by said seal when said at least one of said opposed gauge rings is moved relative to said mandrel to compress said seal between said backup rings.

15. The assembly of claim 13, wherein:

said seal is attached to said opposed gauge rings such that movement of one said backup ring away from another said backup ring on an opposite side of said seal retracts said seal from the tubular or wall for removal or repositioning of the assembly.

16. The assembly of claim 1, wherein:

said configuration further comprises a teardrop shape which reduces extrusion of said seal when in less than full peripheral contact with the tubular or wall.

17. The assembly of claim 1, wherein:

said configuration further comprises a teardrop shape which reduces extrusion of said seal when in full peripheral contact with the tubular or wall.

* * * * *